United States Patent [19]

Rebula et al.

[11] Patent Number: 4,565,324

[45] Date of Patent: Jan. 21, 1986

[54] NOZZLE STRUCTURE FOR SOOTBLOWER

[75] Inventors: Edward Rebula, Bloomfield, Conn.; Alexander J. Kurasz, Columbus, Ohio

[73] Assignee: The Babcock & Wilcox Company, New Orleans, La.

[21] Appl. No.: 499,875

[22] Filed: Jun. 1, 1983

[51] Int. Cl.[4] ..... F22B 37/52; B05B 1/28; B08B 3/02; B08B 9/00

[52] U.S. Cl. ..... 239/290; 122/390; 134/166 C; 239/DIG. 13; 239/550

[58] Field of Search ..... 239/558, 559, 552, 550, 239/549, 561, DIG. 13, 290, 291; 134/166 C, 167 C, 168 C, 169 C, 56 R; 15/316 R; 124/379, 390

[56] References Cited

U.S. PATENT DOCUMENTS

| | | | |
|---|---|---|---|
| 1,809,787 | 6/1931 | McLaren | 239/553.3 X |
| 1,835,215 | 12/1931 | Hammon | 239/558 X |
| 1,863,100 | 9/1931 | Coleman | 239/552 X |
| 1,983,634 | 12/1934 | Nichols | 239/133 |
| 2,343,958 | 3/1944 | Crowe | 239/549 |
| 2,478,557 | 8/1949 | Bell et al. | 239/291 X |
| 3,304,014 | 2/1967 | Hancock et al. | 239/550 X |
| 3,321,140 | 5/1967 | Parkison et al. . | |
| 3,701,482 | 10/1972 | Sachnik | 239/590.3 |
| 3,816,871 | 6/1974 | Karrofskiy | 239/DIG. 13 |
| 4,154,405 | 5/1979 | Stenstrom | 239/509.3 |
| 4,171,096 | 10/1979 | Welsh et al. | 239/291 |
| 4,204,028 | 6/1980 | Shanker | 134/167 C |
| 4,422,882 | 12/1983 | Nelson et al. | 122/390 X |

FOREIGN PATENT DOCUMENTS

| | | | |
|---|---|---|---|
| 905053 | 1/1954 | Fed. Rep. of Germany | 122/390 |
| 504897 | 7/1930 | France . | |
| 84220 | 11/1964 | France | 134/166 C |
| 2423 | of 1915 | United Kingdom | 122/390 |
| 170991 | 11/1921 | United Kingdom | 122/390 |

*Primary Examiner*—Jeffrey V. Nase
*Assistant Examiner*—Kevin Patrick Weldon
*Attorney, Agent, or Firm*—Harness, Dickey & Pierce

[57] ABSTRACT

An improved sootblower nozzle assembly adapted for cleaning heat exchange surfaces or the like comprising a lance tube having at least one nozzle affixed thereon. The nozzle comprises a tubular body formed with a centrally extending discharge throat and a plurality of second apertures arranged around the central discharge throat. A pressurized fluid blowing medium introduced into the lance tube during a cleaning cycle is discharged from the nozzle in the form of a composite stream including a central directionally oriented stream surrounded by a plurality of secondary streams forming an encircling protected shroud to maintain the integrity of the central stream and to increase its impact pressure on the surfaces to be cleaned.

20 Claims, 8 Drawing Figures

NOZZLE STRUCTURE FOR SOOTBLOWER

BACKGROUND OF THE INVENTION

The present invention is broadly applicable to cleaning apparatuses of the type employed for cleaning heat exchange surfaces to remove soot, slag, ash and other accumulated deposits thereon to maintain efficiency in their operation. The improved nozzle construction is particularly applicable, but not necessarily limited to automatic sootblower cleaning devices such as long retracting-type sootblowers as generally described in U.S. Pat. No. 3,608,125; short retracting-type sootblowers such as described in U.S. Pat. No. 3,377,026; and an automatic sootblower for alternatively discharging a liquid and a gaseous blowing medium as described in U.S. Pat. No. 4,209,028 the teachings of which are incorporated herein by reference.

A continuing problem associated with cleaning devices of the types to which the present invention is applicable is the tendency of the jet or stream of fluid blowing medium discharged from the nozzle to loose its integrity between the point of discharge and impingement upon the surface to be cleaned due to the disturbance of the stream by gas currents present in the heat exchange apparatuses, such as high pressure boilers, in which they are employed. Such disturbances result in a fanning out or spreading of the stream or jet resulting in a reduction in the average and maximum velocities of the stream such that a lower peak impact pressure (PIP) of the stream or jet at the point of impingement is obtained thereby reducing the effectiveness and efficiency of the cleaning operation. This problem is particularly pronounced at relatively extreme cleaning distances as frequently encountered in high capacity pressure boilers. The foregoing problem is further aggravated by the fact that optimum nozzle design and optimum nozzle inlet conditions are severly restricted by the limited space available in the lance tube in which the nozzles are mounted.

The present invention provides for an improved nozzle construction adapted to be mounted in a tubular lance connected to a supply of pressurized blowing medium whereby more efficient and effective cleaning is achieved employing the same quantity of blowing medium as compared to prior art nozzle constructions, or alternatively, whereby the same effective cleaning is obtained employing lesser quantities of blowing medium thereby providing for substantial reductions in the consumption of blowing medium to maintain heat exchange equipment in optimum operating condition.

SUMMARY OF THE INVENTION

The benefits and advantages of the present invention are achieved by an improved nozzle construction adapted to be supported in the wall of a lance tube and which comprises a tubular element formed with a first aperture extending substantially centrally there through defining an inlet throat disposed in communication with the interior of the lance tube and a discharge throat for discharging the blowing medium in a directionaly oriented primary stream. The tubular element is further provided with a plurality of second apertures each having an inlet port disposed in communication with the pressurized blowing medium and a discharge port arranged in a circumferentially and radially spaced relationship outwardly of the discharge throat for discharging a plurality of secondary streams of blowing medium in encircling radially spaced relationship around the primary stream forming an encircling shroud. The discharge axis of the nozzle can be varied in accordance with the specific cleaning function to be performed and generally is disposed within a range of about 70 degrees to a position substantially perpendicular to the longitudinal axis of the lance tube.

In accordance with one embodiment of the present invention, the lance tube is provided with indented cup-shape mounting fixtures in which a nozzle is adapted to be threadably secured with the discharge end thereof positioned at or slightly within the peripheral plane of the lance tube enabling retraction of the lance tube and nozzle assemblies inwardly through a conventional wall box during periods of non use. Such nozzle construction preferably employs an inlet throat of an enlarged diameter which terminates in a discharge throat of reduced diameter which is of substantially circular cylindrical configuration and of substantially constant diameter forming an integral stream or jet particularly adapted for use in discharging liquid blowing or cleaning fluids. Optionally, but preferably, the inlet throat of such nozzles is also preferably provided with quide vanes for reducing the turbulance of the liquid cleaning fluid passing there through and enhancing the axial flow component in a position parallel to the axis of the discharge throat.

In accordance with an alternative satisfactory embodiment of the present invention, the nozzle construction is provided with a central aperture of a venturi-type configuration including a converging inlet throat and a diverging discharge throat which is particularly applicable for discharging gaseous blowing medium such as steam and/or air. The secondary apertures defining the secondary jets or streams can be oriented in a direction substantially parallel to the axis of the central discharge throat or, alternatively, can be oriented at an angle substantially parallel to the angle of the annular divergent surface defining the discharge throat.

In either event, a composite stream of pressurized blowing fluid is discharged from the nozzle including a central, integral, high-velocity stream surrounded by a plurality of secondary streams disposed in radially spaced relationship forming a protective shroud for at least a portion of the distance of travel of the central stream from the discharge throat thereby inhibiting disturbing influences on the integrity of the central stream by the cross currents of convection gases present in the heat exchanger apparatus.

The present invention further contemplates an improved process for cleaning heat exchange surfaces employing the improved nozzle construction of the present invention.

Additional benefits and advantages of the present invention will become apparent upon a reading of the description of the preferred embodiments taken in conjunction with the accompanying drawing.

DESCRIPTION OF THE PREFERRED EMBODIMENTS

Figure 1:
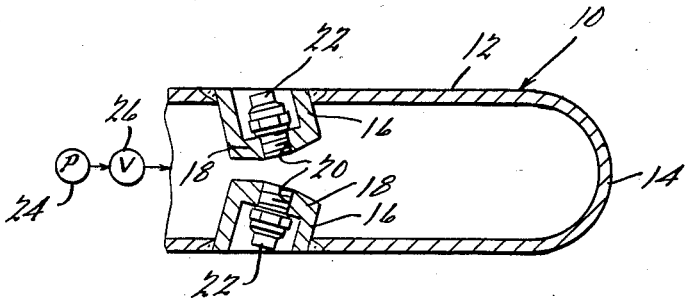
FIG. 1 is a fragmentary vertical longitudinal sectional view partly schematic, of a nozzle block assembly incorporating two removable nozzles constructed in accordance with a first embodiment of the present invention.

Referring now in detail to the drawing, and as maybe best seen in FIG. 1 thereof, a nozzle assembly 10 is illustrated comprising a lance tube 12 which is closed at its outward end by a hemispherical wall 14. A pair of cup-shaped mounting members 16 are securely affixed to the wall of the lance tube 12 such as by welding and the annular bases 18 thereof are formed with an axially extending threaded bore 20 in which a nozzle 22 is threadably secured. The outer ends of the nozzles 22 are preferably disposed within the envelope defining the circular periphery of the outer surface of the lance tube 12 such that the lance tube can be retracted within a wall box provided in the wall of a heat exchanger apparatus during non-use.

The interior of the lance tube 12 is suitably connected to a supply of a pressurized blowing medium adapted to be discharged from the nozzles 22 during the performance of a cleaning cycle. As schematically illustrated in FIG. 1, a suitable pump 24 which may comprise a compressor in the case of an air blowing medium or may comprise a pressure water pump in the case of a liquid blowing medium, or alternatively, may comprise a steam header in the event the blowing medium is steam. In any event, the pump 24 is connected through a flow control valve 26 to supply the fluid blowing medium to the lance tube in accordance with any one of the arrangements as illustrated and disclosed in the United States Patents herein before mentioned in the "Background of the Invention" section of the present application. The fluid blowing medium is supplied to the lance tube in a manner to accommodate the translatory and rotary movement thereof during the course of a cleaning cycle.

Conventionally, at the initiation of a cleaning cycle the lance tube is projected from a fully retracted position within a wall box to a projected cleaning position during which the lance tube is rotated whereby the blowing medium is discharged in the form of a helical blowing pattern against the heat exchange surfaces to be cleaned. In the specific embodiment illustrated in FIG. 1, the axis of each nozzle 22 is provided with a rearward rake to direct the stream of blowing medium against the interior wall surfaces of the heat exchanger apparatus on which the sootblower is mounted. Generally, the axis of discharge of the nozzle 22 is oriented within an angle usually ranging from about 70 degrees to an angle substantially perpendicular to the longitudinal axis of the lance tube consistent with the specific type of cleaning operation to be performed.

Figure 4:
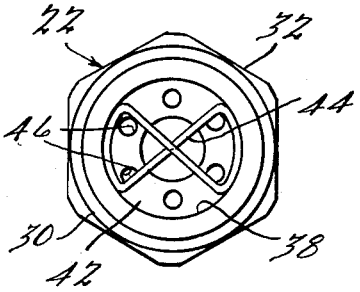
FIG. 4 is an elevational view of the left hand end of the nozzle as shown in FIG. 2.
Figure 2:
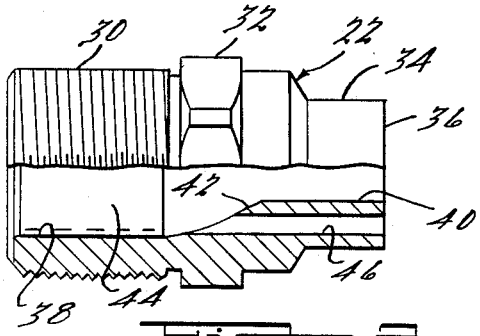
FIG. 2 is an enlarged side elevation view with the lower portion thereof in section of a nozzle employed in the assembly shown in FIG. 1.
Figure 3:
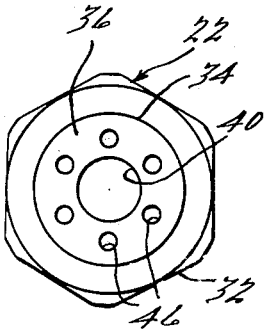
FIG. 3 is a end elevational view of the right hand end of the nozzle shown in FIG. 2.

The nozzle 22, as may be best seen in FIGS. 2 through 4, comprises a tubular body having a threaded portion 30 for removably securing the nozzle in the threaded bore 20 of the mounting members 16, a hexagonal center section 32 to facilitate turning of the nozzle during installation and removal such as by a wrench, a stepped discharge section 34 terminating in a flat face 36. The tubular body 28 is formed with a bore extending substantially centrally there through including an inlet throat section 38 of substantially circular cylindrical configuration and of substantially constant cross section; a discharge throat 40 disposed in axial alignment with the inlet throat and of a reduced diameter and of substantially constant circular cross section; and an intermediate angularly inclined transition section 42. The inlet throat 38 is optionally, and preferably, provided with guide vanes 44 extending substantially axially there along for reducing turbulence in the fluid entering the nozzle and imparting laminar axial flow thereto.

A plurality of second apertures 46 are formed in the discharge section 34 of the nozzle and are disposed in substantially equal circumferentially spaced arrangement around the discharge throat 40 with the inlet end thereof disposed in communication with the incoming pressurized blowing medium in the area of the transition section and the discharge ports thereof terminating at the face 36 of the nozzle. In the specific arrangement illustrated in FIGS. 2–4, six secondary apertures 46 are employed with the axes thereof disposed substantially parallel to the axis of the discharge throat 40.

The arrangement as illustrated in FIGS. 1–4, is particularly suitable for discharging a pressurized liquid blowing medium against heat exchange surfaces which may typically comprise water, aqueous solutions containing additive components as well as aqueous dispersions containing finely particulated additive components such as alkaline substances for effecting a combined cleaning and treatment of the heat exchange surfaces being cleaned. The discharge of such liquid is in the form of a composite stream comprising a central integral stream or jet discharged from the throat 40 of the nozzle which is surrounded in spaced relationship at least at the point of discharge, by a plurality of secondary streams forming an encircling cylindrical shroud which protects the central stream from disruption by gas currents present within the interior of the heat exchange apparatus.

Figure 5:
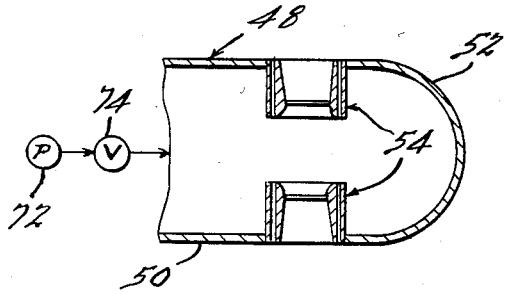
FIG. 5 is a fragmentary longitudinal,vertical section view partly schematic of a nozzle block employing two nozzles constructed in accordance with an alternative satisfactory embodiment of the present invention.
Figure 6:
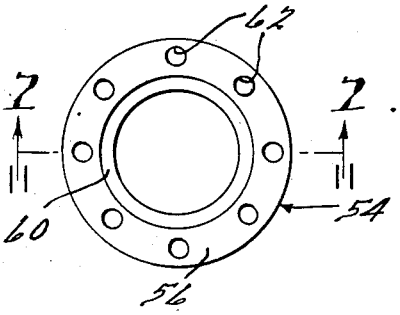
FIG. 6 is an enlarged plan view of the discharge end of one of the nozzles shown in FIG. 5.
Figure 7:
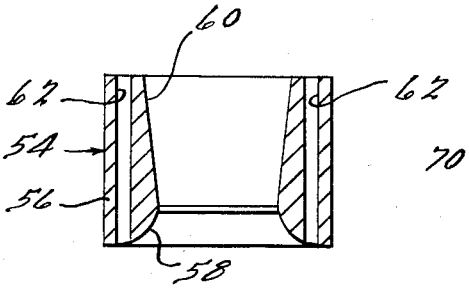
FIG. 7 is a transverse sectional view of the nozzle shown in FIG. 6 as taken along line 7—7 thereof.

In accordance with an alternative satisfactory embodiment as may be best seen in FIGS. 5 through 8, a nozzle assembly is illustrated which is particularly adapted for discharging a gaseous blowing medium such as steam and/or air against heat exchange surfaces to be cleaned. As shown in FIG. 5, the nozzle assembly 48 comprises a lance tube 50 closed at its end by a hemispherical wall 52 and which is formed at its forward end with a pair of diametrically disposed nozzles 54. Each nozzle 54 as best seen in FIGS. 6 and 7, comprises a tubular element 56 which is formed with a centrally extending aperture in the form of a venturi configuration including a convergent inlet throat 58 and a divergent discharge throat 60. A plurality of second apertures 62 are provided in the annular section of the tubular element and are disposed in substantially equal circumferentially spaced intervals around the discharge throat 60 of the nozzle. In the specific embodiment shown in FIGS. 6 and 7, eight secondary apertures are provided with the axis of the discharge ends thereof disposed substantially parallel to the longitudinal axis of the discharge throat. Particularly satisfactory results have been obtained employing discharge throats in which the angle of the divergent surface defining the throat is disposed at an angle of about 7 degrees from the axis of the throat.

Figure 8:
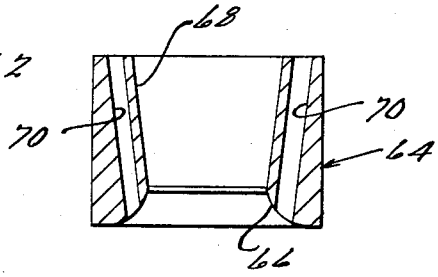
FIG. 8 is a transverse sectional view similar to FIG. 7 of a nozzle constructed in accordance with still another alternative satisfactory embodiment.

In accordance with an alternative satisfactory embodiment of the nozzle assembly 48, a nozzle 64 as shown in FIG. 8 can also satisfactorily be employed including an inlet throat 66, an outlet throat or discharge throat 68 and a plurality of second apertures 70 disposed in circumferentially spaced relationship as shown in FIG. 6 but wherein the axes thereof are oriented in a divergent direction relative to the longitudinal central axis of the discharge throat 68. In the specific embodiment illustrated in FIG. 8, the axes of the second apertures 70 are disposed substantially parallel to the divergent surface defining the discharge throat 68.

The operation of the nozzle assembly 48 is substantially similar to the previously described in connection with the nozzle assembly 10 of FIG. 1. For this purpose, a pump or suitable pressurized supply of blowing medium 72 is connected by means of a flow control valve 74 to the interior of the lance tube 50 which is thereafter discharged in the form of a composite stream including a central primary stream surrounded by a plurality of secondary streams in the form of an encircling shroud.

While it will be apparent that the invention herein disclosed is well calculated to achieve the benefits and advantages as herein above set forth, it will be appreciated that the invention is susceptible to modification, variation and change without departing from the spirit thereof.

What is claimed is:

1. In a sootblower for cleaning heat exchange surfaces within a boiler by impingement of a jet of fluid blowing medium thereagainst including a lance tube disposed in communication with a source of pressurized blowing medium, the improvement comprising at least one nozzle mounted in the peripheral wall of said lance tube for discharging a composite stream of blowing medium therethrough, said nozzle comprising a tubular element formed with a first aperture extending substantially centrally therethrough defining an inlet throat disposed in communication with the interior of said lance tube and a discharge throat for discharging the blowing medium in a directionally oriented primary stream, said tubular element formed with a plurality of second apertures each having an inlet port disposed in communication with the pressurized blowing medium and a discharge port arranged in circumferentially and radially spaced relationship outwardly of said discharge throat for discharging a plurality of secondary streams of blowing medium in encircling radially spaced relationship around the primary stream at the point of discharge of each said secondary streams from each said discharge port, said secondary streams protecting the primary stream from dispersion due to currents within the boiler whereby the primary stream provides improved cleaning performance.

2. The improvement as defined in claim 1 in which the axis of each said discharge port is disposed substantially parallel to the longitudinal axis of said discharge throat.

3. The improvement as defined in claim 1 in which the axis of each said discharge port is oriented in an angularly inclined divergent direction relative to the longitudinal axis of said discharge throat.

4. The improvement as defined in claim 1 in which the axis of each said discharge port is disposed substantially parallel to the axis of the other said discharge port.

5. The improvement as defined in claim 3 in which the axis of each said discharge port is disposed at substantially equal angularly inclined divergent directions.

6. The improvement as defined in claim 1 in which said discharge throat is of a substantially circular cylindrical configuration.

7. The improvement as defined in claim 1 in which each said discharge port is of a substantially circular cylindrical configuration.

8. The improvement as defined in claim 1 in which said discharge throat is of a substantially constant cross sectional area

9. The improvement as defined in claim 1 in which said discharge throat is of a substantially increasing cross sectional area on movement from the upstream to the downstream section thereof.

10. The improvement as defined in claim 1 in which the axis of said discharge throat is disposed at an angle relative to the longitudinal axis of the lance tube.

11. The improvement as defined in claim 1 in which the axis of said discharge throat is disposed at an angle substantially transverse to the longitudinal axis of the lance tube.

12. The improvement as defined in claim 1 further including guide means disposed upstream of said discharge throat imparting an axial flow pattern to the blowing medium passing through said nozzle.

13. The improvement as defined in claim 1 in which said nozzle is removably secured by a threaded connection to said lance tube.

14. The improvement as defined in claim 1 in which the discharge end of said nozzle is disposed substantially within the plane defining the peripheral surface of said lance tube.

15. The improvement as defined in claim 1 in which said first aperture is of a venturi configuration as defined by a convergent inlet throat and a divergent discharge throat on movement in the direction of flow of the blowing medium.

16. The improvement as defined in claim 15 in which the surface defining the divergent discharge throat is disposed at an angle of about 7 degrees relative to the central axis of said discharge throat.

17. The improvement as defined in claim 15 in which the axis of each said discharge port is disposed at an angle substantially parallel to the surface defining the divergent discharge port.

18. A process for cleaning heat exchange surfaces within a boiler which comprises the steps of; providing a cleaning apparatus including a lance tube having at least one nozzle mounted in the peripheral wall thereof, introducing a pressurized blowing medium into the interior of said lance tube for discharge in the form of a composite stream from said nozzle against the heat exchange surfaces to be cleaned, said composite stream including a central directionally oriented stream of said blowing medium and a second stream of said blowing medium substantially encircling said central stream in the form of a radially spaced shroud at the point of discharge of said central stream and said second stream from said nozzle, said secondary stream protecting said central stream from dispersion due to currents within the boiler whereby said central stream provides improved cleaning performance.

19. The process of claim 18 in which said blowing medium comprises a liquid.

20. The process of claim 18 in which said blowing medium comprises a gas.

* * * * *